US010351944B2

(12) United States Patent
Rickert et al.

(10) Patent No.: US 10,351,944 B2
(45) Date of Patent: Jul. 16, 2019

(54) FERROUS ALLOY

(71) Applicant: ArvinMeritor Technology, LLC, Troy, MI (US)

(72) Inventors: Danielle Rickert, Royal Oak, MI (US); Kenneth K. Yu, Clarkston, MI (US)

(73) Assignee: ArvinMeritor Technology, LLC, Troy, MI (US)

( * ) Notice: Subject to any disclaimer, the term of this patent is extended or adjusted under 35 U.S.C. 154(b) by 325 days.

(21) Appl. No.: 15/320,049

(22) PCT Filed: May 28, 2015

(86) PCT No.: PCT/US2015/032844

§ 371 (c)(1),
(2) Date: Dec. 19, 2016

(87) PCT Pub. No.: WO2015/195285

PCT Pub. Date: Dec. 23, 2015

(65) Prior Publication Data

US 2017/0198381 A1 Jul. 13, 2017

Related U.S. Application Data

(60) Provisional application No. 62/014,962, filed on Jun. 20, 2014.

(51) Int. Cl.
*C21D 1/06* (2006.01)
*C21D 1/18* (2006.01)
(Continued)

(52) U.S. Cl.
CPC ..... *C23C 8/32* (2013.01); *C21D 1/06* (2013.01); *C21D 1/18* (2013.01); *C21D 1/20* (2013.01);
(Continued)

(58) Field of Classification Search
CPC ... C21D 1/06; C21D 1/18; C21D 1/20; C21D 6/00; C22C 38/002; C22C 38/02;
(Continued)

(56) References Cited

U.S. PATENT DOCUMENTS 2,978,320 A * 4/1961 Larson ..... C22C 37/04 420/14
3,093,518 A * 6/1963 Bieber ..... C22C 38/08 420/94
(Continued)

FOREIGN PATENT DOCUMENTS

CN 1424425 A 6/2003
CN 1518606 A 8/2004
(Continued)

OTHER PUBLICATIONS

The State Intellectual Property Office of China, Chinese Office Action for the corresponding Chinese Patent Application No. 201580033164.7 dated Nov. 15, 2017.

*Primary Examiner* — Cam N. Nguyen
(74) *Attorney, Agent, or Firm* — Brooks Kushman P.C.

(57) ABSTRACT

Ferrous alloys and methods of forming the ferrous alloys are disclosed. A ferrous alloy material may include iron and boron and an outer case layer. The outer case layer may have an average grain size of ASTM 9 or finer and may have a case thickness of at least 0.001 inches. The boron concentration of the outer case layer may be greater than a boron concentration of a core of the material. The ferrous alloy material may also include a nitrogen scavenging agent and may have a nitrogen concentration in the outer case layer that is greater than a nitrogen concentration in the core of the material. The alloy may be formed by performing a carburizing step and a nitriding step above the upper critical
(Continued)

temperature on a boron steel. The method may include a single heat and quench cycle.

20 Claims, 7 Drawing Sheets

(51) Int. Cl.

| | |
|---|---|
| ***C21D 1/20*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/14*** | (2006.01) |
| ***C23C 8/22*** | (2006.01) |
| ***C23C 8/26*** | (2006.01) |
| ***C23C 8/32*** | (2006.01) |

(52) U.S. Cl.
CPC ..... *C21D 6/00* (2013.01); *C22C 38/002* (2013.01); *C22C 38/02* (2013.01); *C22C 38/04* (2013.01); *C22C 38/14* (2013.01); *C23C 8/22* (2013.01); *C23C 8/26* (2013.01); *C21D 2211/002* (2013.01); *C21D 2211/008* (2013.01)

(58) Field of Classification Search
CPC ..... C22C 38/04; C22C 38/14; C23C 8/22; C23C 8/26; C23C 8/32
See application file for complete search history.

(56) References Cited

U.S. PATENT DOCUMENTS 3,300,347 A * 1/1967 Kasza ..... F16B 19/05 148/326
3,341,372 A * 9/1967 Sadowski ..... C22C 38/105 148/328
3,359,094 A * 12/1967 Bieber ..... C22C 38/105 148/328
3,396,013 A * 8/1968 Mihalisin ..... C22C 38/105 420/103
3,445,299 A * 5/1969 Laudenslager, Jr. .... C22C 38/02 148/100
3,449,159 A * 6/1969 Baldi ..... C23C 10/02 427/253
3,453,102 A * 7/1969 Floreen ..... C22C 38/105 420/95
3,485,620 A * 12/1969 Bieber ..... C22C 19/07 148/328
3,488,186 A * 1/1970 Floreen ..... C22C 38/105 420/95
3,627,513 A * 12/1971 Scharfstein ..... C22C 38/08 420/443
3,719,474 A * 3/1973 Bieber et al. ..... C22C 19/07 420/103
3,809,547 A * 5/1974 Lewis et al. ..... C21C 5/52 75/10.16
6,572,713 B2 * 6/2003 Kucharczyk ..... C22C 38/001 148/329
2002/0102442 A1 * 8/2002 Shimao ..... G11B 25/043 428/692.1
2012/0298262 A1 11/2012 Hirakami et al.
2013/0180626 A1 7/2013 Yoshida

FOREIGN PATENT DOCUMENTS

| | | | |
|---|---|---|---|
| CN | 1526836 | A | 9/2004 |
| CN | 102131945 | A | 7/2011 |
| CN | 103124801 | A | 5/2013 |
| DE | 4139975 | A1 | 6/1993 |
| EP | 2578717 | A1 | 4/2013 |
| JP | S55158271 | A | 12/1980 |
| JP | 2001200348 | A | 7/2001 |

* cited by examiner

FERROUS ALLOY

CROSS-REFERENCE TO RELATED APPLICATIONS

This application is the U.S. national stage of PCT Application No. PCT/US15/032844, filed May 28, 2015, which claims the benefit of U.S. provisional application Ser. No. 62/014,962 filed Jun. 20, 2014, the disclosures of which are hereby incorporated in their entireties by reference herein.

TECHNICAL FIELD

This patent application relates to a ferrous alloy, for example, a ferrous alloy having a fine grain case layer.

BACKGROUND

Ferrous alloys are used in many applications, including vehicle components. In some applications, both toughness and strength/hardness may be important properties of the ferrous alloy. However, in general, as the strength/hardness of a material increases, the toughness typically decreases. In order to mitigate the reduction in toughness, additional alloying elements are typically added to the alloy and/or the alloy may be subjected to multiple heat treatments.

SUMMARY

In at least one embodiment, a method of forming a ferrous alloy is provided. The method may include treating a precursor ferrous material comprising iron, a nitrogen scavenging agent, and boron in a nitrogen enriched atmosphere at a temperature above an upper critical temperature of the precursor ferrous material. The method may further include cooling the precursor ferrous material below the upper critical temperature to form the ferrous alloy. The ferrous alloy may include a fine grain case layer having an average grain size of ASTM 9 or finer.

The method may further include introducing the precursor ferrous material to a carbon enriched atmosphere when the temperature is above the upper critical temperature. In one embodiment, the method may include treating the precursor ferrous material in a carbon enriched atmosphere at a first temperature above the upper critical temperature, wherein treating the precursor ferrous material in the nitrogen enriched atmosphere is performed at a second temperature above upper critical temperature.

The second temperature may be lower than the first temperature. In one embodiment, the method may include treating the precursor ferrous material in the carbon enriched atmosphere at a temperature of about 1450° F.-2200° F. for a time period of 1 to 28 hours and treating the precursor ferrous material in the nitrogen enriched atmosphere at the second temperature for a second time period. The second temperature may be at least 25° F. less than the first temperature.

The precursor ferrous material may include carbon ranging in amount from 0.17-1.5 weight %, manganese in amount ranging from 0.07-1.75 weight %, silicon in amount ranging from 0.15-0.6 weight %, phosphorus in amount less than 0.03 weight %, sulfur in amount less than 0.05 weight %, and iron in amount greater than 80 weight %. In one embodiment, the precursor ferrous material includes a total of less than 1.0 weight % percent of molybdenum, chromium, nickel, copper, and tungsten.

The fine grain case layer may have a thickness of at least 0.001 inches. The precursor ferrous material may include at least 0.0005 weight % boron. The nitrogen scavenging agent may include one or more of vanadium, titanium, tungsten, aluminum, zirconium, niobium, chromium, and molybdenum and may be present in an amount from about 0.01 to 0.1 weight % of the precursor ferrous material. In one embodiment, the precursor ferrous material is quenched only once to form the fine grain case layer.

In at least one embodiment, a ferrous alloy material is provided. The material may include iron, a nitrogen scavenging agent, and boron, the material having a fine grain case layer. The fine case layer may have an average grain size of ASTM 9 or finer and a nitrogen concentration that is greater than a nitrogen concentration of a core of the material. The fine grain case layer may have an average grain size in the range of ASTM 12 to ASTM 14. A core of the ferrous alloy material may include at least 0.0005 weight % boron and the fine grain case layer may include a greater boron concentration than the core. In one embodiment, the ferrous alloy material includes a total of less than 1.0 weight % percent of molybdenum, chromium, nickel, copper, and tungsten. The nitrogen concentration of the fine grain case layer may be more than twice the nitrogen concentration of the core of the material.

In at least one embodiment, a ferrous material is provided. The material may include iron and atomic boron, the material having an outer case layer. The outer case layer may have a case thickness of 0.001 inches to 0.500 inches, a nitrogen concentration that is greater than a nitrogen concentration of a core of the material, and a boron concentration that is greater than a boron concentration of the core of the material.

The material may also include an inner case layer disposed between the outer case layer and the core. The inner case layer may have a boron concentration that is less than the boron concentrations of both the outer case layer and the core. The outer case layer may have an average grain size of ASTM 9 or finer. In one embodiment, the outer case layer has an average grain size in the range of ASTM 12 to ASTM 14.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As described in the Background, alloys with high strength and/or hardness tend to have reduced toughness. In order to increase the toughness of these materials, alloying elements such as molybdenum, chromium, nickel, copper, and tungsten are typically added as alloying elements. These additional elements may add significant costs to the material. Another method of increasing the toughness is to perform multiple heat treatments to the alloy. The heat treatments may be performed to re-austenitize the alloys to refine the grain size. These heat treatments add time and costs to the material processing.

It has been discovered that a high strength and high toughness ferrous alloy may be produced with greatly reduced alloying elements and reduced heat treatment cycles (e.g., heating and quenching). For example, the typical alloying elements of molybdenum, chromium, nickel, copper, and tungsten may be reduced to a total of less than 1 weight % of the ferrous alloy and there may be only a single heat treatment and quench cycle. As described in further detail, below, the ferrous alloy material may be formed by carburizing and nitriding a ferrous alloy that includes boron (e.g., boron steel). This is a surprising and unexpected result. Conventional wisdom teaches against nitriding boron steel, since the addition of boron makes the steel already hardenable, which would make nitriding unnecessary and redundant. Carbonitriding of boron steel is therefore counter intuitive, because the purpose of nitrogen addition during the carburizing process is to increase the case hardenability of low alloy or plain steels. In addition, nitrogen addition during carbonitriding process is typically performed below 1600° F., which would significantly increase the carburizing cycle and manufacturing cost of the ferrous alloy without any foreseeable benefit.

Figure 1:
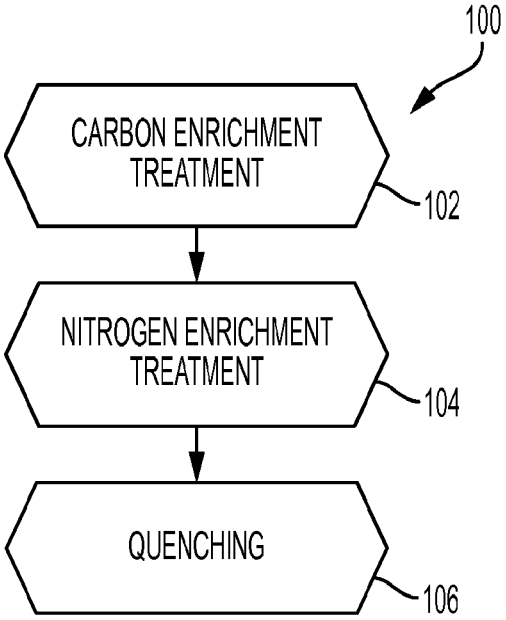
FIG. 1 depicts a flow chart diagram of a process for making a ferrous alloy in accordance with embodiments described herein.

FIG. 1 depicts a method 100 for producing a fine grain ferrous alloy or a ferrous alloy with a fine grain case layer. The method 100 may produce a ferrous alloy that is both strong and tough, while reducing the amount of expensive alloying elements and lengthy and costly heat treatments. Although embodiments will be described in reference to an exemplary method and materials and products produced by this method, it is also to be understood that this disclosure does not limit scope to the specific embodiments described below, as specific components and conditions may vary. For example, the description of a group or class of materials as suitable for given purpose does not necessarily indicate preference for those materials over other equally suitable materials providing similar affects or properties. In detail to the embodiments herein, except in the examples, or where otherwise expressly indicated, all numerical quantities in this description indicating amounts of material or conditions of reaction are to be understood as modified by the word "about" in describing the broadest scope. Practice within the numerical limits stated may be generally preferred, but are not necessarily limiting. It is also be noted that, as used in the specification and the appended claims, the singular form "a," "an," and "the" comprise plural referents unless the context indicates otherwise.

In step 102 of method 100, a ferrous material is treated at a selected temperature above the upper critical temperature (hereafter referred to as '$Ac_3$ Temperature') of the ferrous material while exposed to a selected atmosphere, that is, while exposed to selected partial pressures of various gaseous constituents. Although, for clarity the term "ferrous material" is generally used when describing the material being treated at the various steps of method 100, it is to be understood that the ferrous material undergoes microstructural and/or compositional changes throughout the method 100. Therefore, the ferrous material can be generally identified as a precursor ferrous material when being introduced in step 102 of the method 100, various intermediate materials when undergoing treatments throughout the method 100, and a final ferrous alloy when completing method 100. The upper critical temperature ($Ac_3$ temperature) is the lower boundary temperature for maintaining the ferrous material in a fully austenitic phase. The $Ac_3$ temperature depends on the specific composition of the ferrous material being utilized. In addition to selecting a temperature above the $Ac_3$ Temperature, the treatment temperature can be selected based on desired case layer thickness, processing time, and furnace capabilities. In one embodiment, temperatures of 1450° F.-1800° F. (787.8° C.-982.2° C.) may be utilized.

The ferrous material may be introduced to a carbon enriched atmosphere at step 102, wherein the atmospheric carbon potential can be selected based on processing time and desired material properties. As used herein, a carbon enriched atmosphere describes a condition in which carbon atoms from components of the atmosphere are available for diffusion into the ferrous material (e.g., at a carbon potential above the carbon content of the precursor alloy). By way of example, carbon potential in the carburizing atmosphere may be above 0.5 weight % carbon and may range from 0.5 weight % carbon potential to 1.4 weight % carbon potential. The carburizing atmosphere may be provided for a time period sufficient to provide a desired carbon diffusion into the ferrous material.

Treatment times in the carburizing atmosphere can vary for selected applications based on desired case layer depth and case properties. In general, longer treatment times will result in a higher carbon concentration (up to the carbon potential) and deeper case depth. In one embodiment, the treatment time may range from one (1) to twenty eight (28) hours. In another embodiment, the treatment time may range from four (4) to twenty (20) hours. The treatment temperature of the carburizing step may vary for selected applications based on desired case layer depth and case properties. In general, higher treatment temperatures will result in a higher carbon concentration (up to the carbon potential) and deeper case depth. In one embodiment, the treatment temperature may be from the $Ac_3$ temperature to 2200° F. (1204.4° C.). In another embodiment, the treatment temperature may be from 1450° F. to 2200° F. (787.8° C. to 1204.4° C.). In another embodiment, the treatment temperature may be from 1450° F. to 1800° F. (787.8° C. to 982.2° C.).

In step 104 of method 100, the ferrous material may be introduced to a nitrogen enriched atmosphere. As used herein, nitrogen enriched describes a condition in which nitrogen from components of the atmosphere are available for diffusion into the ferrous material (e.g., at a nitrogen potential above the nitrogen content of the precursor alloy). In one embodiment, an atmosphere containing selected levels of ammonia is utilized to induce nitrogen into the ferrous material. Nitrogen enrichment treatment times may vary for selected applications based on desired case layer depth and case properties. In one embodiment, the treatment time may range from one half (0.5) to three (3) hours. In general, higher treatment temperatures will result in a higher nitrogen concentration (up to the nitrogen potential) and deeper case depth. In one embodiment, the treatment temperature may be from the $Ac_3$ temperature to 1800° F. (982.2° C.). In another embodiment, the treatment temperature may be from 1450° F. to 1800° F. (787.8° C. to 982.2° C.).

In one embodiment, the ferrous material is treated in a carbon enriched, nitrogen neutral atmosphere at a first treatment temperature. Nitrogen neutral may mean that the atmosphere is such that the nitrogen content of the ferrous material will not be increased by the treatment. Subsequently, the ferrous material may be treated in a carbon enriched atmosphere in combination with a nitrogen enriched atmosphere at a second treatment temperature. The second treatment temperature may be lower than the first treatment temperature, wherein the temperature difference is believed to discourage grain growth while providing sufficient nitrogen absorption rates. In one embodiment, the second treatment temperature is at least 25° F. (or ° C.) lower than the first treatment temperature. In another embodiment, the second treatment temperature is at least 50° F. (or ° C.) lower than the first treatment temperature. In another embodiment, the second treatment temperature is at least 100° F. (or ° C.) lower than the first treatment temperature.

In one embodiment, the ferrous material undergoes an austenitizing treatment wherein the ferrous material is heated to a temperature of 1675° F. (912.8° C.) at step 102, wherein the alloy is exposed to carbon enriched, nitrogen neutral atmosphere with a carbon potential of 0.75 weight % carbon for thirteen (13) hours. The temperature is then decreased to 1550° F. (843.3° C.) and ammonia is added to the atmosphere as a carrier gas for nitrogen atoms at step 104, wherein, the ferrous materials is held in the atmosphere containing carbon and nitrogen for 1.25 hours. Both the introduction of the carbon enriched atmosphere and the introduction of the nitrogen enriched or carbon plus nitrogen enriched atmosphere may occur when the case of the ferrous material is in a fully austenitic phase. In other embodiments, the diffusion of nitrogen into the ferrous material can be accomplished without exposure to a carbon enriched atmosphere before and/or during, the austenitizing treatment.

In step 106, the ferrous material is quenched. The quenching temperature and quenching duration may be selected to provide selected or certain microstructural characteristics. In one embodiment, the ferrous material is quenched in a salt bath at a temperature above the martensite start ($M_s$) temperature to provide a case with primarily bainitic or a mixture of bainitc and martensitic microstructures, for example at a temperature above 525° F. (273.9° C.) such as a temperature of 530° F. (276.7° C.). Further, the ferrous material may be quenched for a sufficient duration to ensure an isothermal transformation within the ferrous material. In one embodiment, the ferrous material is maintained in the salt bath at the desired quench temperature for one hour. In one embodiment, the ferrous material is quenched at a temperature below the martensite start ($M_s$) temperature to provide a case with a primarily martensitic microstructure, for example quenched at a temperature of 200° F. (93.3° C.).

Embodiments above may produce ferrous material with fine grain sizes without subjecting the materials to multiple heating and quenching operations (e.g., the ferrous material is heated above the $Ac_3$ temperature and quenched below the $Ac_3$ temperature only once). Subsequent to quenching, the post-treated ferrous alloy can be subject to other material conditioning steps. For example, in one embodiment, the post-treated ferrous alloy can be subjected to tempering. In one embodiment, the post-treated ferrous alloy can subjected to shot-peening.

In one embodiment, the precursor ferrous material comprises atomic boron and a nitrogen scavenging agent. Atomic or unbonded boron may be present in varying amount in various embodiments. In at least one embodiment, the precursor material may include at least 0.0005 weight % boron. For example, for some applications, atomic boron may range from about 0.0005 weight % to about 0.006 weight %. The nitrogen scavenging agent may be an element or substance that prevents the atomic or unbonded boron in the alloy from interacting with nitrogen that may be present in the bulk of the alloy. The amount of nitrogen scavenging agent can be selected to adequately diminish interaction between boron and nitrogen in the precursor ferrous material and based on desired material properties and material costs. For example, the nitrogen scavenging agent can be present at a level of about 0.01 weight % to 0.1 weight % and can comprise one or more of the following elements: vanadium, titanium, tungsten, aluminum, zirconium, niobium, chromium, and molybdenum.

In at least one embodiment, the ferrous alloy may include more than trace amounts of boron, such as at least 0.0001 weight %. For example, the alloy may include at least 0.0005 weight %, at least 0.001 weight %, at least 0.005 weight %, or at least 0.01 weight %. The boron may be atomic or unbonded boron, for example, due to the presence of a nitrogen scavenging agent. In one embodiment, the ferrous alloy composition includes boron in an amount ranging from about 0.001 weight % to 0.004 weight %, or any sub-range therein, such as 0.0015 weight % to 0.0035 weight % or 0.002 weight % to 0.003 weight %. In one embodiment, the ferrous alloy composition includes Titanium in amount ranging from about 0.02 weight % to 0.08 weight %, or any sub-range therein, such as 0.03 weight % to 0.07 weight % or 0.04 weight % to 0.06 weight %.

The ferrous material can comprise any of several grades of commercial steel along with various other classes of iron based material. Without limitation to the scope of the embodiments, examples of these commercial steels may include 10B35, 10B36, 15B21, 15B28H, 15B29, 15B30H, 15B35H, 15B37H, 15B41H, 15B48H, and 15B62H. Without limitation to the scope of the embodiments, general compositional ranges of ferrous materials include carbon ranging in amount from 0.17-1.5 weight %, manganese ranging in amount from 0.07-1.75 weight %, silicon ranging from 0.15-0.6 weight %, phosphorus in amount less than 0.030 weight %, sulfur in amount less than 0.050 weight %, and iron in amount greater than 80 weight %. Ferrous alloys described herein can have desired high hardness and fatigue properties at lower costs than those that utilize traditional alloying agents (e.g., "alloy steels"). The ferrous material can achieve desired high hardness and fatigue properties while comprising less than 1 weight % traditional alloying agents including one or more of the following elements: molybdenum, chromium, nickel, copper, and tungsten. The alloy may have less than 1 weight % of each alloying element individually and in total (e.g., molybdenum+chromium+nickel+copper+tungsten≤1 wt. %).

Figure 2:
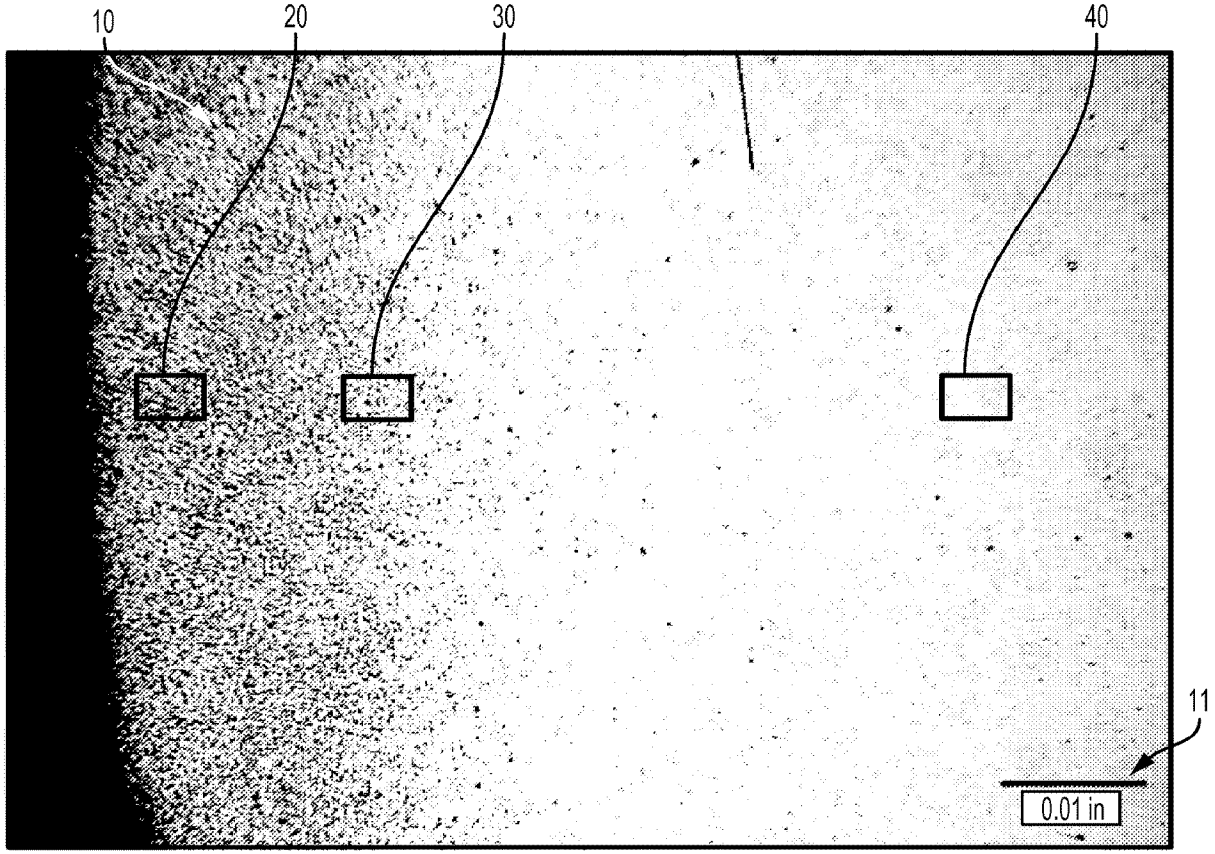
FIG. 2 depicts an optical micrograph of a ferrous alloy in accordance with an embodiment described herein.

FIG. 2 depicts a micrograph of a cross section of a ferrous alloy 10 created by treating a 15B29 steel precursory material by the method 100. The micrograph is magnified such that scale line 11 represents 0.01 inches (0.254 mm). Ferrous alloy 10 includes portions 20, 30, and 40, which are representative layers of the post-treated alloy 10.

Figure 3:
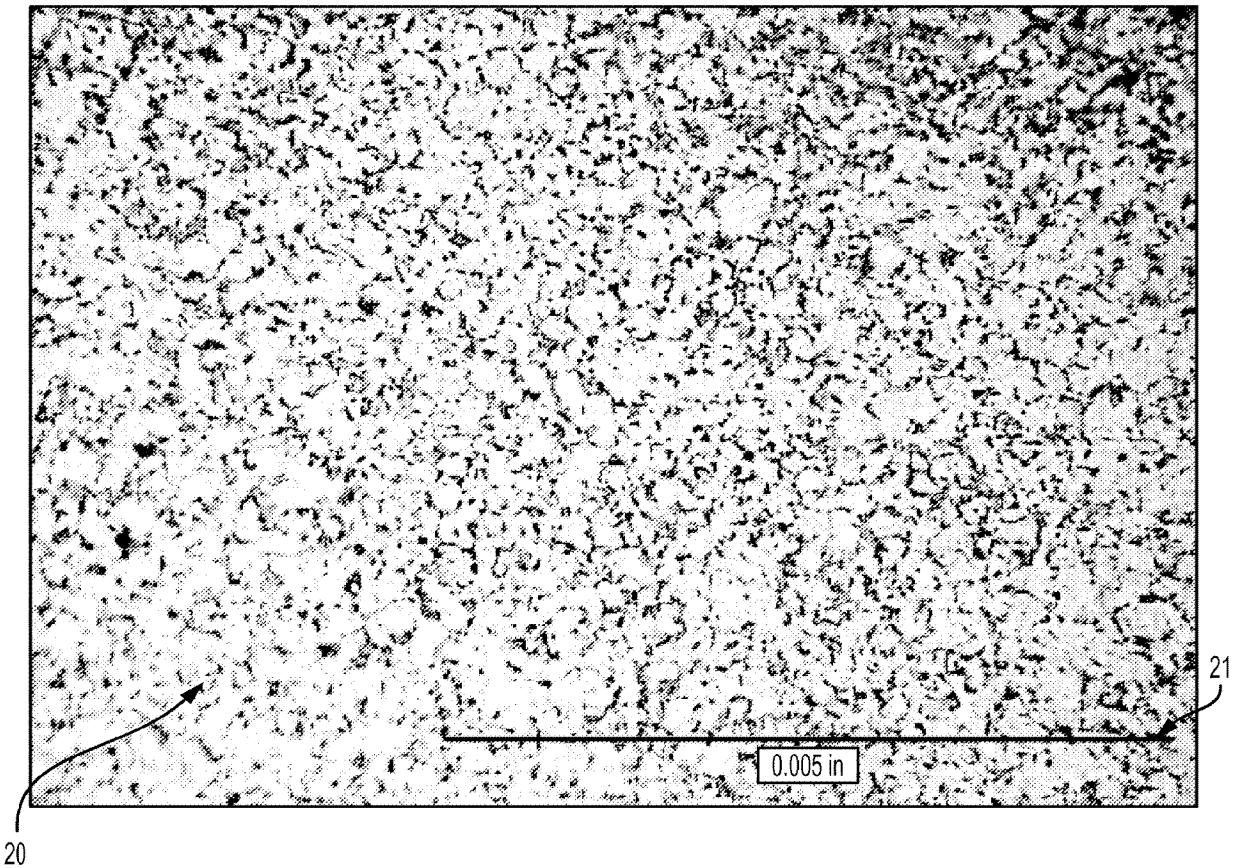
FIG. 3 depicts an optical micrograph of a portion of the ferrous alloy of FIG. 2.

FIG. 3 depicts portion 20 magnified so that scale line 21 represents 0.005 inches (0.127 mm). Portion 20 may be referred to as a case layer, a fine grain case layer, or an outer case layer. The case layer 20 may extend from a surface of the alloy inward toward a core of the alloy. The case layer 20 may at least partially surround the core of the alloy. In one embodiment, the case layer 20 completely or substantially completely surrounds the core of the alloy (e.g., at least 95%). Grain samples within the portion 20 had sizes, measured via the line intercept method, represented in Table 1, below:

TABLE 1

| Measurement | AVERAGE GRAIN DIAMETER - INCHES ($10^{-3}$) | AVERAGE GRAIN DIAMETER - μm | Approximate ASTM GRAIN SIZE |
|---|---|---|---|
| 1 | 0.155 | 3.937 | 13 |
| 2 | 0.173 | 4.394 | 12 |
| 3 | 0.170 | 4.318 | 12 |
| 4 | 0.173 | 4.394 | 12 |
| 5 | 0.167 | 4.242 | 12.5 |
| 6 | 0.136 | 3.454 | 13 |
| 7 | 0.164 | 4.166 | 12.5 |
| 8 | 0.173 | 4.394 | 12 |
| 9 | 0.186 | 4.724 | 12 |
| 10 | 0.167 | 4.242 | 12.5 |

Grain size sampling in the portion 20 measured grain sizes substantially in the range of 12-13. The grain size distribution of the case layer is substantially homogenous with 90% to 100% of the grains falling within the above size ranges. In another embodiment, the grain sizes listed may be mean or average grain sizes. Although, one embodiment depicts grains ASTM 12 and finer within the portion 20, in other embodiments, grain size can be controlled by varying composition and temperatures to achieve other grain sizes. The portion 20 may have any grain size, such as ASTM 0 to ASTM 14. For example, the average grain size may be ASTM 9 or finer (e.g., $\leq 0.625\times10^{-3}$ in. or 15.9 μm), ASTM 10 or finer (e.g., $\leq 0.442\times10^{-3}$ in. or 11.2 μm), ASTM 11 or finer (e.g., $\leq 0.313\times10^{-3}$ in. or 7.9 μm), ASTM 12 or finer (e.g., $\leq 0.221\times10^{-3}$ in. or 5.6 μm), ASTM 13 or finer (e.g., $\leq 0.156\times10^{-3}$ in. or 4.0 μm), or ASTM 14 or finer (e.g., $\leq 0.111\times10^{-3}$ in. or 2.8 μm). The average grain size may also be within a range of any of the above, for example, from ASTM 9 to ASTM 14, ASTM 9 to ASTM 12, ASTM 12 to ASTM 14, or any other sub-range. Although grains in portion 20 may have a primarily martensitic microstructure, quench temperature along with other heating and cooling processes may be adjusted to provide other microstructures having substantially similar grain size ranges. For example, in an alternate embodiment, a ferrous alloy may have a primarily bainitic microstructure while having a substantially similar grain size as described above. The depth of the fine grain case layer can be selected based on treatment time, treatment temperature, treatment atmospheric composition and base alloy characteristics. In one embodiment, the case depth of the ferrous alloys (e.g., the thickness of the fine grain case layer 20) may be from 0.001 inches to 0.500 inches (0.0000254 mm to 12.7 mm). In another embodiment, the case depth may be from 0.01 to 0.3 inches (0.254 mm to 7.62 mm). In another embodiment, the case depth may be from 0.03 to 0.1 inches (0.762 mm to 2.54 mm).

Figure 4:
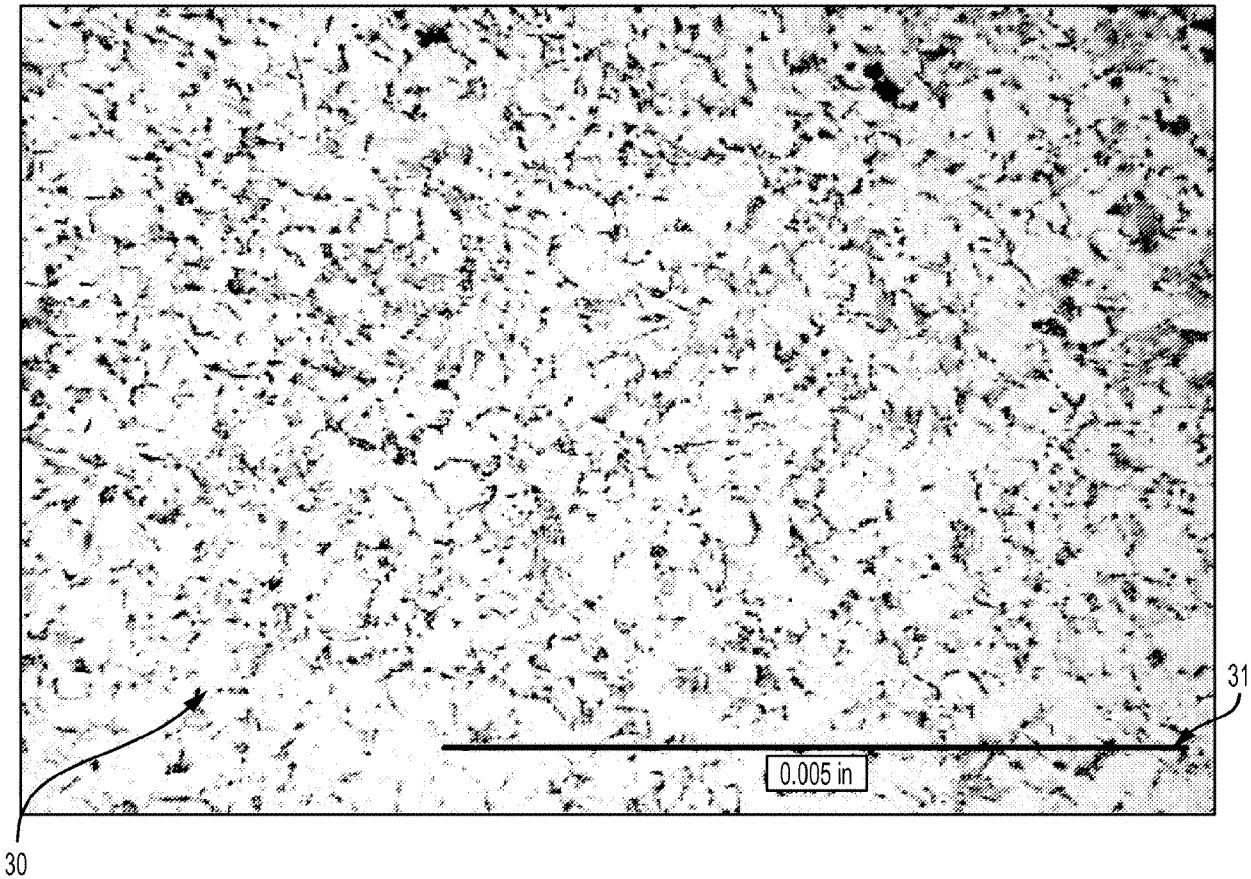
FIG. 4 depicts an optical micrograph of another portion of the ferrous alloy of FIG. 2.
Figure 5:
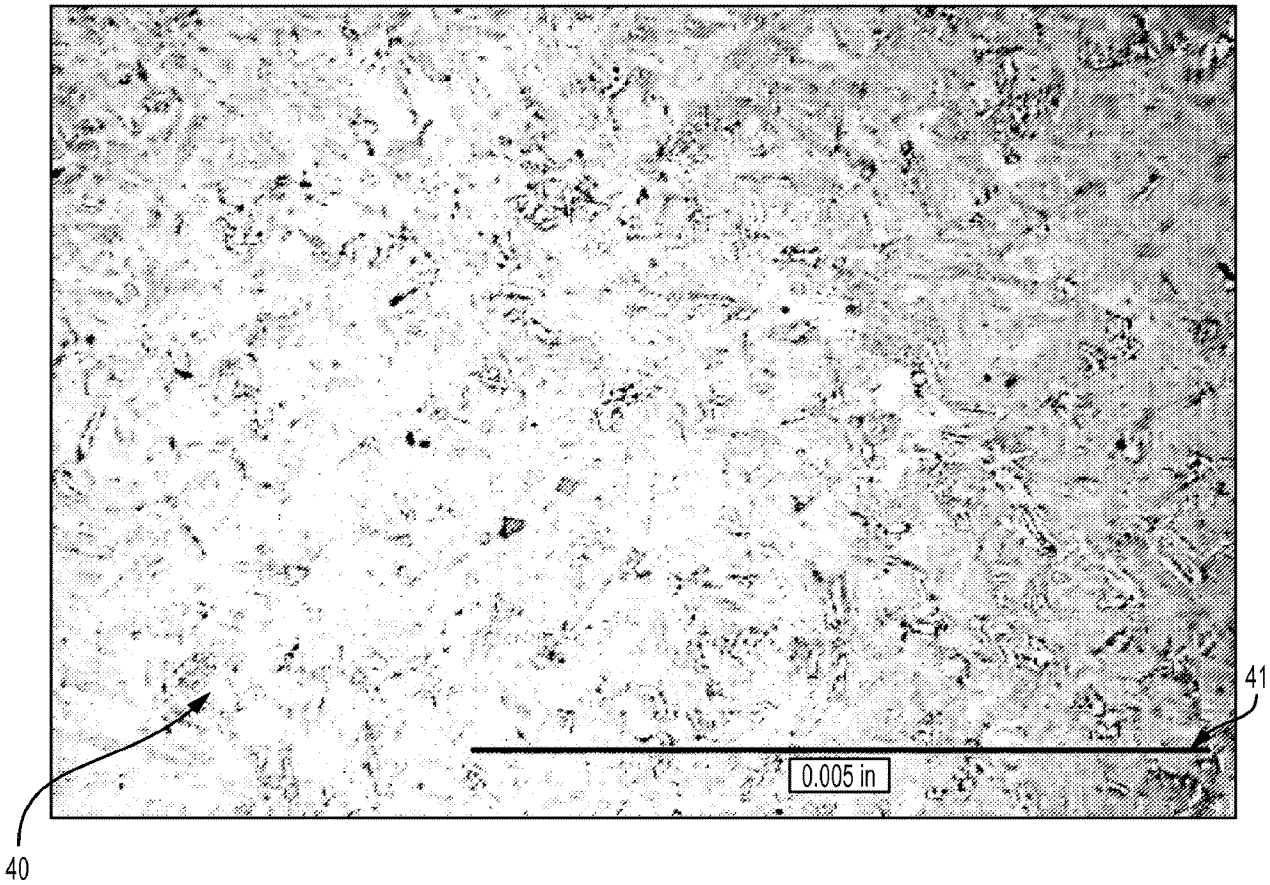
FIG. 5 depicts an optical micrograph of another portion of the ferrous alloy of FIG. 2.

FIG. 4 depicts the portion 30 of the ferrous alloy 10 magnified so that scale line 31 represents 0.005 inches (0.127 mm). The portion 30 includes a transition between the case and the core of the ferrous alloy 10. The portion 30 may be referred to as the inner case layer or an intermediate or transition layer. FIG. 5 depicts the portion 40 magnified so that scale line 41 represents 0.005 inches (0.127 mm). The portion 40 is in a core of the ferrous alloy 10, or may be referred to as the bulk of the alloy 10. In at least one embodiment, the inner case layer 30 may be directly between (or sandwiched by) the outer case layer 20 and the 40. For example, the inner case layer 30 may be in direct contact with the outer case layer 20 and the core 40.

Figure 6:
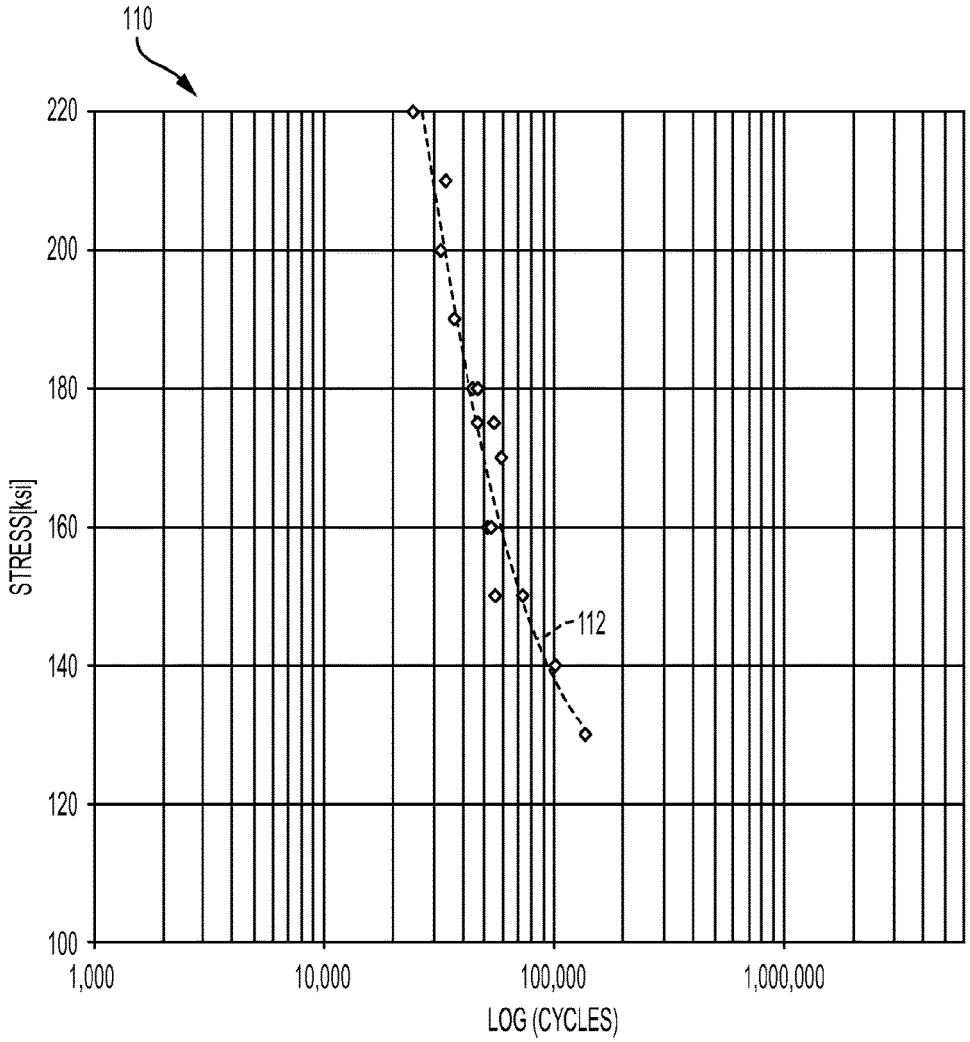
FIG. 6 depicts a graph of fatigue stress measurements of the ferrous alloy of FIG. 2.

FIG. 6 depicts a graph 110 of bending fatigue stress measurements in kilopounds per square inch ('ksi') of the ferrous alloy 100 at various cycles. As shown in a graph data 112, fatigue stress is above 200 ksi and above 30,000 cycles, which demonstrates improvement over a substantially similar fatigue test on prior ferrous alloys. For example, the ferrous alloy 100 outperforms alloys having higher concentrations of alloying elements, particularly at high stresses.

Figure 7:
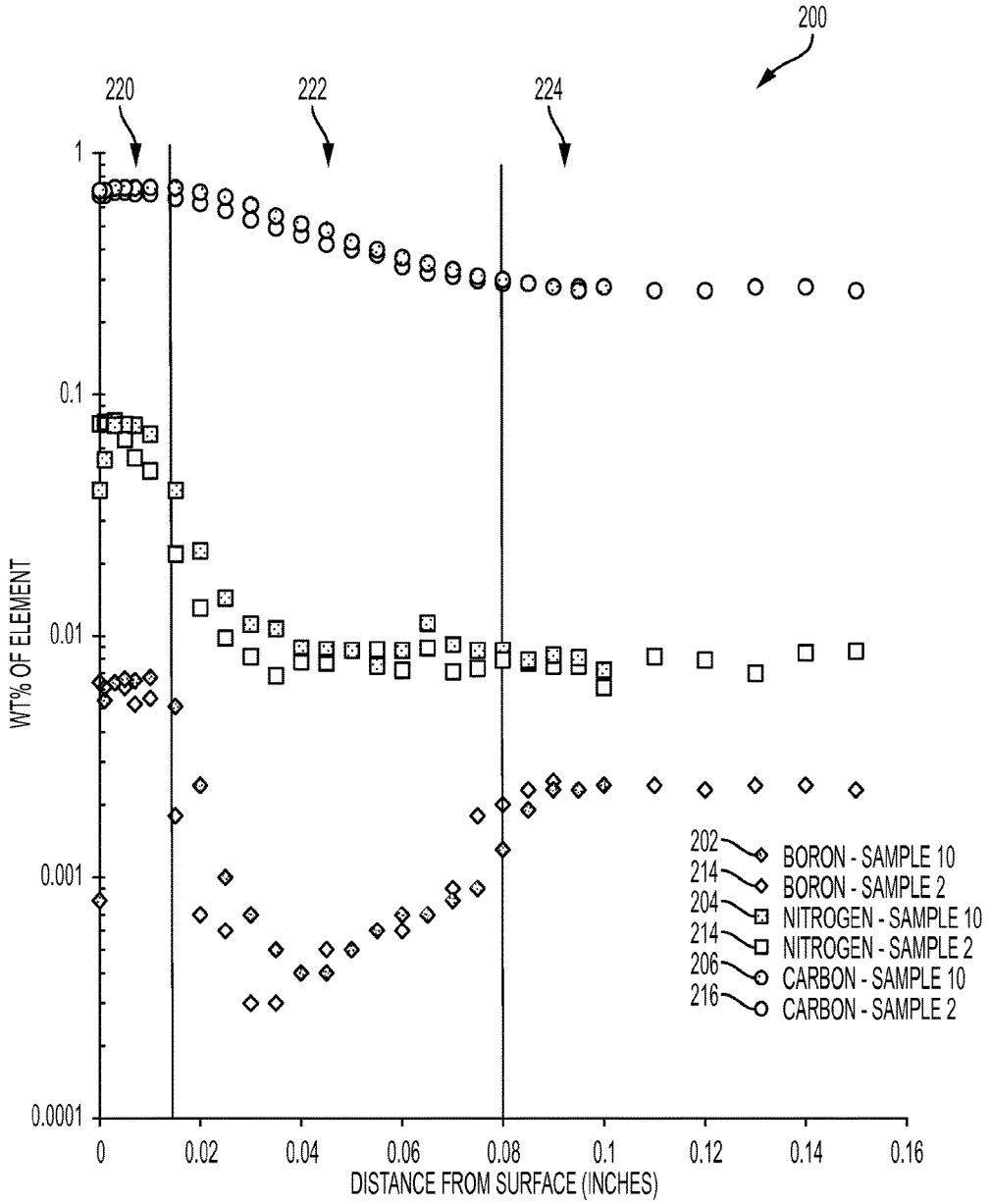
FIG. 7 depicts a graph of elemental weight percentage at distances from a surface of the ferrous alloy of FIG. 2 and of another ferrous alloy.

FIG. 7 depicts a graph 200 of elemental weight percentage at distances from a surface of the ferrous alloy 10 and a ferrous alloy 2. Like ferrous alloy 10, the ferrous alloy 2 comprises a 15B29 commercial boron steel, treated according to the method 100 described above.

A cross section of each of the alloy 10 and the alloy 2 was cut and weight % of elements at various distances from the surface of the alloy 10 were measured. The boron levels 202, nitrogen levels 204, and carbon levels 206 of the alloy 10 labeled 'Sample 10' in graph 200 are plotted as weight % (y-axis) of the alloy 10 versus distances (x-axis) from the surface of the alloy 10. Likewise, the boron levels 212, nitrogen levels 214, and the carbon levels 216 of alloy 2 labeled 'Sample 2' are plotted as weight % (y-axis) of the alloy 10 versus distances (x-axis) from the surface of the alloy 2.

The graph 200 shows segments based on a distance from the surface of each respective alloy 2 and alloy 10, wherein an outer casing 220 (similar to outer case layer 20) is designated at distances from the surface to about 0.017 inches (0.432 mm); an inner casing 222 (similar to inner case layer 30) is designated at distances from 0.017 to 0.080 inches (0.432 mm to 2.032 mm) and a core 224 (similar to core or bulk 40) is designated at distances greater than 0.080 from the surface. As shown in graph 200, the outer casing 220 has enriched levels of boron 0.050 weight %-0.070 weight % over the levels of boron (0.022 weight %-0.023 weight %) when compared to the core 224. The inner casing has depleted levels of boron (less than 0.020 weight % when compared to the core 224.

Without being limited by any particular theory, boron of the ferrous material appears to migrate from the inner casing to the outer casing during the treatment 100, thereby providing a material having the beneficial properties described herein. It is believed that the boron migrates from the inner casing due to the increased nitrogen concentration in the outer casing. The migrating boron may be atomic or unbonded boron, which may be due to the presence of nitrogen scavenging agents in the alloy. Bonded boron may not migrate in the same manner due to being locked in place by its bonds to other elements. The boron may react with the nitrogen in the outer casing to form nitrogen-boron precipitates, compounds, or intermetallics, such as BN. It is believed that these nitrogen-boron compounds contribute to the refinement of the grain size. The nitrogen-boron precipitates may give the ferrous material (or at least the outer casing) a strength that is consistent with precipitate hardened/strengthened steels.

Although specific distances are provided to define the outer casing, the inner casing and the core in example alloys 10 and 2, it is to be understood that varying treatment times and temperatures and varying levels of ammonia or other nitrogen donating substance during the nitriding step may produce different depths and boron levels in layers of the alloys 2, 10. In addition, the transition from one zone to another (e.g., outer casing to inner casing) may be gradual or continuous, and not marked by a sharp change.

Accordingly, in at least one embodiment, a ferrous alloy 10 may be provided having an outer casing 20 having a fine grain size (e.g., average of ASTM 9 or finer) compared to a bulk or core 40 of the alloy. The outer casing 20 may also have an increased concentration of nitrogen and/or boron, compared to the core 40 of the alloy. In some embodiments, the outer casing 20 may also have an increased concentration of carbon compared to the core 40. The increased nitrogen concentration in the outer casing 20 may be from a nitrogen enrichment process (e.g., step 104), while the increased boron concentration in the outer casing 20 may be from the migration of boron to the outer casing 20 from outside the outer casing 20 (e.g., the inner casing 30). If there is an increased carbon concentration in the outer casing 20, it may be from a carburizing process (e.g., step 102). As described above, the migration of the boron may come from an inner casing 30 between the outer casing 20 and the core 40. This migration may occur during the nitriding processes and/or the carburizing and nitriding processes (e.g., steps 102 and/or 104). The migration may result in the inner casing being boron-depleted relative to the outer casing 20 and the core 40 (e.g., having a lower concentration than either). The inner casing 30 may have a carbon and/or nitrogen concentration that generally decreases from the adjacent the outer casing 20 to the adjacent the core 40.

In at least one embodiment, the outer casing 20 may have a nitrogen concentration that is at least twice the bulk concentration. For example, the nitrogen concentration may be at least five times or at least ten times the bulk concentration. In one embodiment, the nitrogen concentration of the outer casing 20 may be at least 0.02 weight %, such as at least 0.03 weight % or 0.05 weight %. In one embodiment, the nitrogen concentration of the core 40 may be no greater than 0.01 weight % or no greater than 0.015 weight %.

Parts comprising the ferrous alloy 10 may be cut, forged, cast, machined or otherwise fabricated before or after the treatment process above. For example in one embodiment, gears are cut from the precursor ferrous alloy, and the gears are then subjected to treatments of method 100 described above.

In exemplary embodiments, components of a vehicle drivetrain system comprise the ferrous alloy 10. For example, heavy duty vehicle drivetrain components and off-highway drivetrain vehicle components can comprise the ferrous alloy 10. In one embodiment, gears of a vehicle drivetrain system comprise the ferrous alloy 10. Gears utilizing the ferrous alloy 10 may include gears utilized in power transfer cases, gears utilized in differentials and gears utilized to modify torque ratio levels including those in transmission systems and wheel ends. The ferrous alloy may be used or incorporated into any component where good wear resistance is desired, such as in shafts or bearings. The ferrous alloy may also be used or incorporated into any component where a combination of high strength and toughness are desired.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a ferrous alloy comprising:

treating a precursor ferrous material comprising iron, a nitrogen scavenging agent, and boron in a nitrogen enriched atmosphere at a temperature above an upper critical temperature of the precursor ferrous material; and cooling the precursor ferrous material below the upper critical temperature to form the ferrous alloy, wherein the ferrous alloy includes a fine grain case layer having an average grain size of ASTM 9 or finer, wherein the precursor ferrous material includes carbon ranging in amount from 0.17-1.5 weight %, manganese in amount ranging from 0.07-1.75 weight %, silicon in amount ranging from 0.15-0.6 weight %, phosphorus in amount less than 0.03 weight %, sulfur in amount less than 0.05 weight %, and iron in amount greater than 80 weight %.

2. The method of claim 1, further comprising introducing the precursor ferrous material to a carbon enriched atmosphere when the temperature is above the upper critical temperature.

3. The method of claim 1, further comprising:

treating the precursor ferrous material in a carbon enriched atmosphere at a first temperature above the upper critical temperature;

wherein treating the precursor ferrous material in the nitrogen enriched atmosphere is performed at a second temperature above upper critical temperature.

4. The method of claim 3, wherein the second temperature is lower than the first temperature.

5. The method of claim 4, further comprising:

treating the precursor ferrous material in the carbon enriched atmosphere at a temperature of about 1450° F.-2200° F. for a time period of 1 to 28 hours; and treating the precursor ferrous material in the nitrogen enriched atmosphere at the second temperature for a second time period, wherein the second temperature is at least 25° F. less than the first temperature.

6. The method of claim 1, wherein the precursor ferrous material includes a total of less than 1.0 weight % percent of molybdenum, chromium, nickel, copper, and tungsten.

7. The method of claim 1, wherein the fine grain case layer has a thickness of at least 0.001 inches.

8. The method of claim 1, wherein the precursor ferrous material includes at least 0.0005 weight % boron.

9. The method of claim 1, wherein the nitrogen scavenging agent includes one or more of vanadium, titanium, tungsten, aluminum, zirconium, niobium, chromium, and molybdenum and is present in an amount from about 0.01 to 0.1 weight % of the precursor ferrous material.

10. The method of claim 1, wherein the precursor ferrous material is quenched only once to form the fine grain case layer.

11. A method of forming a ferrous alloy comprising:

treating a precursor ferrous material comprising iron, a nitrogen scavenging agent, and boron in a nitrogen enriched atmosphere at a temperature above an upper critical temperature of the precursor ferrous material; and cooling the precursor ferrous material below the upper critical temperature to form the ferrous alloy, wherein the ferrous alloy includes a fine grain case layer having an average grain size of ASTM 9 or finer, wherein the fine grain case layer has a thickness of at least 0.001 inches.

12. The method of claim 11 wherein the precursor ferrous material is quenched only once to form the fine grain case layer.

13. The method of claim 12 wherein the precursor ferrous material includes carbon ranging in amount from 0.17-1.5 weight %, manganese in amount ranging from 0.07-1.75 weight %, silicon in amount ranging from 0.15-0.6 weight %, phosphorus in amount less than 0.03 weight %, sulfur in amount less than 0.05 weight %, and iron in amount greater than 80 weight %.

14. The method of claim 11 wherein the precursor ferrous material includes carbon ranging in amount from 0.17-1.5 weight %, manganese in amount ranging from 0.07-1.75 weight %, silicon in amount ranging from 0.15-0.6 weight %, phosphorus in amount less than 0.03 weight %, sulfur in amount less than 0.05 weight %, and iron in amount greater than 80 weight %.

15. The method of claim 11 wherein the precursor ferrous material includes a total of less than 1.0 weight % percent of molybdenum, chromium, nickel, copper, and tungsten.

16. The method of claim 11 wherein the precursor ferrous material includes at least 0.0005 weight % boron.

17. A method of forming a ferrous alloy comprising:

treating a precursor ferrous material comprising iron, a nitrogen scavenging agent, and boron in a nitrogen enriched atmosphere at a temperature above an upper critical temperature of the precursor ferrous material; and cooling the precursor ferrous material below the upper critical temperature to form the ferrous alloy, wherein the ferrous alloy includes a fine grain case layer having an average grain size of ASTM 9 or finer, wherein the precursor ferrous material is quenched only once to form the fine grain case layer.

18. The method of claim 17 wherein the precursor ferrous material includes carbon ranging in amount from 0.17-1.5 weight %, manganese in amount ranging from 0.07-1.75 weight %, silicon in amount ranging from 0.15-0.6 weight %, phosphorus in amount less than 0.03 weight %, sulfur in amount less than 0.05 weight %, and iron in amount greater than 80 weight %.

19. The method of claim 17 wherein the ferrous alloy has an inner case layer disposed between an outer case layer and a core, the inner case layer having a boron concentration that is less than boron concentrations of both the outer case layer and the core.

20. The method of claim 19 wherein a nitrogen concentration of the fine grain case layer is more than twice the nitrogen concentration of the core.

* * * * *